US007571770B2

(12) United States Patent
DiFoggio et al.

(10) Patent No.: US 7,571,770 B2
(45) Date of Patent: Aug. 11, 2009

(54) DOWNHOLE COOLING BASED ON THERMO-TUNNELING OF ELECTRONS

(75) Inventors: Rocco DiFoggio, Houston, TX (US); Frederick E. Shipley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 242 days.

(21) Appl. No.: 11/087,362

(22) Filed: Mar. 23, 2005

(65) Prior Publication Data

US 2006/0213660 A1 Sep. 28, 2006

(51) Int. Cl.
*E21B 36/00* (2006.01)

(52) U.S. Cl. ..... 166/302; 166/57

(58) Field of Classification Search ..... 166/302, 166/57; 175/17

See application file for complete search history.

(56) References Cited

U.S. PATENT DOCUMENTS

| | | | | |
|---|---|---|---|---|
| 3,169,200 | A * | 2/1965 | Huffman | 310/306 |
| 4,375,157 | A * | 3/1983 | Boesen | 62/49.2 |
| 5,265,677 | A | 11/1993 | Schultz | 166/302 |
| 5,931,000 | A | 8/1999 | Turner et al. | 62/3.2 |
| 6,065,293 | A | 5/2000 | Ghoshal | 62/3.2 |
| 6,134,892 | A | 10/2000 | Turner et al. | 62/3.2 |
| 6,341,498 | B1 * | 1/2002 | DiFoggio | 62/259.2 |
| 6,589,682 | B1 | 7/2003 | Fleckner et al. | 429/34 |
| 6,712,258 | B2 * | 3/2004 | Ghoshal | 228/134 |
| 6,713,519 | B2 | 3/2004 | Wang et al. | 518/715 |
| 6,769,487 | B2 * | 8/2004 | Hache | 166/302 |
| 6,787,691 | B2 | 9/2004 | Fleurial et al. | 136/203 |
| 2002/0011479 | A1 | 1/2002 | Narita et al. | 219/390 |
| 2005/0097911 | A1 * | 5/2005 | Revellat et al. | 62/259.2 |
| 2006/0086118 | A1 * | 4/2006 | Venkatasubramanian et al. | 62/259.2 |
| 2007/0053394 | A1 * | 3/2007 | Cox | 372/34 |

OTHER PUBLICATIONS

Lasance et al.; *Advances In High-Performace Cooling for Electronics*, Electronics Cooling, http://electronics-cooling.com/articles/2005/2005_nov_article2.php, Jul. 23, 2007, pp. 1-21.

Lasance et al., *Advances In High-Performance Cooling For Electronics*, Current Window R & D Projects—Nov. 2006, US Department of Energy, Energy Efficiency and renewable energy, pp. 1-27, 22 Figs.

* cited by examiner

*Primary Examiner*—William P Neuder
(74) *Attorney, Agent, or Firm*—Madan & Sriram, P.C.

(57) ABSTRACT

An apparatus for and a method of cooling electronic components in downhole equipment using the principles of quantum tunneling.

30 Claims, 8 Drawing Sheets

Thermionic Converter

DOWNHOLE COOLING BASED ON THERMO-TUNNELING OF ELECTRONS

BACKGROUND OF THE INVENTION

1. Field of the Invention

This present invention relates to a downhole tool for wireline and measurement-while-drilling applications, and in particular relates to a method and apparatus for cooling of electronic components deployed in a downhole tool suspended from a wireline or a drillstring.

2. Background of the Invention

In underground drilling applications, such as oil and gas exploration and development, a borehole is drilled through a formation deep in the earth. Such boreholes are drilled or formed by a drillbit connected to an end of a series of sections of drill pipe, so as to form an assembly commonly referred to as a "drillstring." The drillstring extends from the Earth's surface to the bottom of the bore hole. As the drillbit rotates, it advances into the earth, thereby forming the borehole. In order to lubricate the drill bit and flush cuttings from its path as it advances, a high pressure fluid, referred to as "drilling mud," is directed through an internal passage in the drillstring and out through the drill bit. The drilling mud then flows to the surface through an annular passage formed between the exterior of the drillstring and the surface of the bore.

The distal or bottom end of the drillstring, which includes the drillbit, is referred to as a bottomhole assembly (BHA). In addition to the drillbit, the BHA often includes specialized modules or tools within the drillstring that make up the electrical system for the drillstring. Such modules often include sensing modules, a control module and a pulser module. In many applications, the sensing modules provide the drillstring operator with information regarding the formation as it is being drilled through, using techniques commonly referred to as "measurement while drilling" (MWD) or "logging while drilling" (LWD). For example, resistivity sensors may be used to transmit and receive high frequency signals (e.g., electromagnetic waves) that travel through the formation surrounding the sensor. It is to be noted that the sensors fall within the dictionary definition of electronics:

> "of, relating to, or utilizing devices constructed or working by the methods or principles of electronics; also: implemented on or by means of a computer."

In other applications, sensing modules are utilized to provide data concerning the direction of the drilling and can be used, for example, to control the direction of a steerable drillbit as it advances. Steering sensors may include a magnetometer to sense azimuth and an accelerometer to sense inclination. Signals from the sensor modules are typically received and processed in the control module of the downhole tool. The control module may incorporate specialized electronic components to digitize and store the sensor data. In addition, the control module may also direct the pulser modules to generate acoustic pulses within the flow of drilling fluid that contain information derived from the sensor signals. These pressure pulses are transmitted to the surface, where they are detected and decoded, thereby providing information to the drill operator.

It will be appreciated that the drilling environment subjects the sensors to a great deal of vibration. In addition, there is usually a monotonic increase in temperature with increasing depth. The rate of increase in temperature per unit depth in the earth is called the geothermal gradient. The geothermal gradient varies from one location to another, but it averages 25 to 30° C./km. Thus, at a well depth of 6 km, the temperature could be close to 200° C. Accordingly, the sensors and the other electronics on the BHA have to be able to withstand such high temperatures.

After the well has been drilled, additional measurements are made using sensors conveyed on a wireline or coiled tubing. These sensors are used for obtaining additional measurements of properties of the earth formation. With wireline measurements, the mechanical stress on the sensors and electronics due to drillstring vibrations is absent, but it is still necessary that they withstand the high operating temperatures downhole.

In addition to the inherently high temperatures downhole, the electronics themselves are a heat source. For example, the components of a typical MWD system (i.e., a magnetometer, accelerometer, solenoid driver, microprocessor, power supply and gamma scintillator) may generate over 20 watts of heat. Overheating frequently results in failure or reduced life expectancy for thermally exposed electronic components. For example, photo multiplier tubes, which are used in gamma scintillators and nuclear detectors for converting light energy from a scintillating crystal into electrical current, cannot operate above 175° C. Consequently, cooling of the electronic components is important.

Numerous methods have been used in the past for cooling of downhole equipment. U.S. Pat. No. 5,265,677 to Schultz discloses a downhole cooling system including a container holding a refrigerant. The cooling system also includes heat transfer elements for conducting refrigerant from the container in proximity to the electrical member so that a temperature adjacent the electrical member is less than ambient well bore temperature and preferably less than the maximum of the rated temperature operating range. The cooling system further includes a device for moving refrigerant from the container and through the heat transfer elements in response to pressure in the well bore. Another example of a refrigerant based cooling system is discloses in U.S. Pat. No. 6,769,487 to Hache.

Cooling systems based on refrigeration suffer from several drawbacks. These include their complexity. Compressor seals do not perform their function properly at elevated temperatures. In addition, they require a power source. The maximum coefficient of performance ($COP_{max}$) of a refrigerator is given by $T_l/\Delta T$, where $T_l$ is the temperature of the low temperature reservoir (such as the elctronics) and $\Delta T$ is the temperature differential. With increased temperature differential, the $COP_{max}$ is reduced, so that more work is wasted in the refrigeration cycle. The wasted work appears in the system as additional heat! There is thus an inherent limit on the utility of refrigerant based cooling systems. It is to be noted that the $COP_{max}$ is a theoretical upper limit, and any practical device typically achieves a small fraction of $COP_{max}$, typically 20-30%.

Thermoelectric coolers are also part of the prior art in the field. U.S. Pat. No. 4,375,157 to Boesen, includes thermoelectric coolers that are powered from the surface. The thermoelectric coolers transfer heat from the electronics area within a Dewar flask to the well fluid by means of a vapor phase heat transfer pipe. U.S. Pat. No. 5,931,000 and U.S. Pat. No. 6,134,892 to Turner et al. discloses a system in which thermoelectric cooling is used as part of a cascaded cooling system.

In the most general sense, thermoelectricity can be defined as the conversion of temperature differences to electricity and vice-versa. Two examples of thermoelectricity are the Peltier-Seebeck effect (thermocouples) and thermionic conversion (heating a material to release electrons). Seebeck formed a closed loop by joining the ends of two wires of dissimilar metals (a thermocouple circuit) and found that when the two junctions of the metal wires are at different temperatures, a voltage is created that is proportional to the temperature difference between the junctions. The Peltier effect is the reverse of the Seebeck effect. It corresponds to creation of a temperature difference from an applied voltage. Peltier found that when a current passes through a thermocouple, the temperature of one junction increases while the temperature of the other decreases, so that heat is transferred between junctions. The heat flow is proportional to the electrical current and the direction of heat flow is reversed when the current is reversed. Thermionic conversion is the generation of an electric current when electrons released by thermionic emission are collected. Thermionic emission is the ejection of electrons from a material when it is heated hot enough to raise some of the electron's energy above the binding energy (work function) of the material. It is the basis for a vacuum diode tube in which electrons are ejected from a heated anode are collected at a cathode. Thermoelectric cooling can be achieved through thermionic conversion. FIG. 5*b* is a schematic representation of such a thermionic cooler. A voltage source 205 is connected to a collector 201 and an emitter 207 of electrons 203. Under certain conditions, a temperature difference results due to heat 221 being extracted from the collector and the emitter is cooled. FIG. 5*a* is a circuit representation of a thermionic cooler. FIG. 6*a* is a representation of thermionic cooling as a diode. In this example, there is a small distance d of 1-10 μm between two electrodes and a potential difference (work function) ΔE between them. In order to get a significant number of electrons to jump over the barrier, the material must be heated and must have a low work function. The lowest work function materials are based on Alkali metals such as cesium, where the work function approaches 1 eV. Most metals have work functions in the 4-5 eV range. At 4-5 eV, significant emission does not occur until the cathode is hotter than 2000° K. Some metals melt before they emit electrons. Thoriated tungsten, which is used for cathode ray tubes, is heated to 1,950° K. There is not much need for forced cooling of objects at such high temperatures above ambient. The actual efficiency achieved with prior art thermionic cooling is typically 5-10% of the theoretical Carnot limit $COP_{max}$. A third example of thermoelectricity is thermotunneling in which electrons can quantum-mechanically tunnel from one unheated material to another when the distance between the two materials is small enough. Because it operates on a different principle, a quantum thermocooler can operate efficiently at the 80-200 C temperatures that are commonly found in the downhole environment. This is discussed below with reference to FIG. 6*b*.

As noted above, Dewar flasks have been used in conjunction with thermoelectric coolers. To reduce the thermal load, tool designers have tried surrounding electronic components with thermal insulators or placed the electronics in a vacuum flask. Such attempts at thermal load reduction, while partially successful, have proven problematic in part because of heat conducted from outside the electronics chamber and into the electronics flask via the feed-through wires connected to the electronic components. Moreover, heat generated by the electronic components trapped inside of the flask also raises the ambient operating temperature. The term "electronic components" is intended to include electronic circuitry as well as sensors that operate on principles of electronics.

Typically, the electronic insulator flasks have utilized high thermal capacity materials to insulate the electronics to retard heat transfer from the bore hole into the tool and into the electronics chamber. Designers place insulators adjacent to the electronic components to retard the increase in temperature caused by heat entering the flask and heat generated within the flask by the electronics. The design goal is to keep the ambient temperature inside of the electronics chamber flask below the critical temperature at which electronic failure may occur. Designers seek to keep the temperature below critical for the duration of the logging run, which is usually less than 12 hours.

Electronic container flasks, unfortunately, take as long to cool down as they take to heat up. Thus, once the internal flask temperature exceeds the critical temperature for the electronics, it requires many hours to cool down before an electronics flask can be used again safely. Thus, there is a need to provide an electronics component cooling system that actually removes heat from the flask or electronics/sensor region without requiring extremely long cool down cycles which impede downhole operations. As discussed above, electronic cooling via thermoelectric and compressor cooling systems has been considered, however, neither have proven to be viable solutions.

U.S. Pat. No. 6,341,498 to DiFoggio teaches a cooling system in which an electronic component is cooled by using one or more containers of liquid and sorbent that transfer heat from the component to the fluid in the well bore. The electronic components are part of a downhole tool that may be on a drillstring through which a drilling fluid flows, a wireline, or coiled tubing. This cooling system comprises a housing adapted to be disposed in a wellbore, the sorption cooler comprising a water supply adjacent to a sensor or electronics to be cooled; a Dewar flask lined with phase change material surrounding the electronics/sensor and liquid supply; a vapor passage for transferring vapor from the water supply; and a sorbent in thermal contact with the housing for receiving and adsorbing the water vapor from the vapor passage and transferring the heat from the sorbed water vapor through the housing to the drilling fluid or well bore. The electronic circuits or sensors adjacent to the water supply are cooled by the evaporation of the liquid. While a major advance over earlier methods, the cooling capacity is limited by the amount of phase change material that is conveyed downhole.

Thus, there is a need for a cooling system that addresses the problems encountered in known systems discussed above. Consequently, it would be desirable to provide a rugged yet reliable system for effectively cooling the electronic circuits and sensors utilized that is suitable for use in a well bore. It is desirable to provide a cooling system that is capable of being used in an assembly of a drillstring or wireline.

SUMMARY OF THE INVENTION

One embodiment of the present invention is an apparatus for use in a borehole in an earth formation. The apparatus a downhole assembly including one or more formation evaluation (FE) sensors which make a measurement indicative of a parameter of interest of the earth formation. The apparatus includes electronic components on the downhole assembly that is substantially inoperable above a predefined temperature. A quantum thermocooler cools the electronic components below the predefined temperature. The predefined temperature may be less than about 200° C. The downhole assembly may include a bottomhole assembly (BHA) including a drillbit or a string of logging instruments. Any one of a variety of FE sensors may be used, including gamma ray sensors, resistivity sensors and/or nuclear magnetic resonance sensors. The quantum thermocooler may include an emitter and a collector with a spacing of less than about 20 nm.

A Dewar flask may be used to contain the electronic components. A phase change material may also be used to facilitate maintaining the electronic components below the predefined temperature. Specific embodiments of the invention may include those in which temperatures to which electronic components are subjected or particularly high, such as a resistivity sensor on a drill bit; or those in which it is required to maintain particularly low temperature, such as a NMR sensor including a trapped field magnet. The electronic components may include a processor that determines a parameter of interest of the earth formation such as a horizontal resistivity of the formation, a vertical resistivity of the formation, a positions of an interface in the formation, a clay bound water of the formation, bound volume irreducible, and porosity.

Another embodiment of the invention is method of evaluating an earth formation. The method uses one or more formation evaluation (FE) sensors on a downhole assembly within a borehole in the earth formation for making a measurement indicative of a parameter of interest of the earth formation. A quantum thermocooler is used for maintaining electronic components on the downhole assembly below a predefined temperature. The emitter and the collector of the quantum thermocooler may be separated by less than 20 nm. The thermocooler may be provided with thermal fins to dissipate heat into borehole fluid. The downhole assembly may include a BHA that is conveyed on a drilling tubular or may include a string of logging instruments conveyed on a wireline. Any one of a variety of FE sensors may be used, including gamma ray sensors, resistivity sensors and/or nuclear magnetic resonance sensors.

The quantum thermocooler may be used in applications where components are close to a particularly large heat source, such as for bit mounted sensors. The quantum thermocooler may also be used in applications where particularly low temperatures are needed, such as in NMR sensors with a trapped field magnet.

Another embodiment of the invention is a machine readable medium for use in conjunction with an apparatus conveyed in a borehole in an earth formation. The apparatus includes a downhole assembly including one or more formation evaluation (FE) sensors which make a measurement indicative of a parameter of interest of the earth formation. The downhole assembly includes electronic components that are substantially inoperable above a predefined temperature. A quantum thermocooler maintains the electronic components below the predefined temperature. The medium includes instructions that enable a processor to determine from an output of the one or more FE sensors the parameter of interest. The medium is selected from the group consisting of (i) a ROM, (ii) an EPROM, (iii) an EAROM, (iv) a Flash Memory, and (v) an Optical disk.

BRIEF DESCRIPTION OF THE FIGURES

The application is best understood with reference to the following drawings wherein like numbers in different figures refer to like components and in which.

Figure 7:
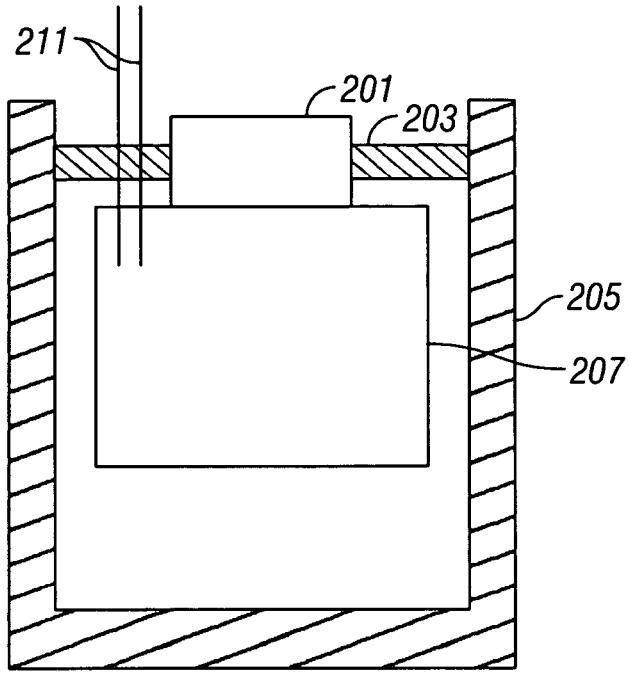
Figure 8:
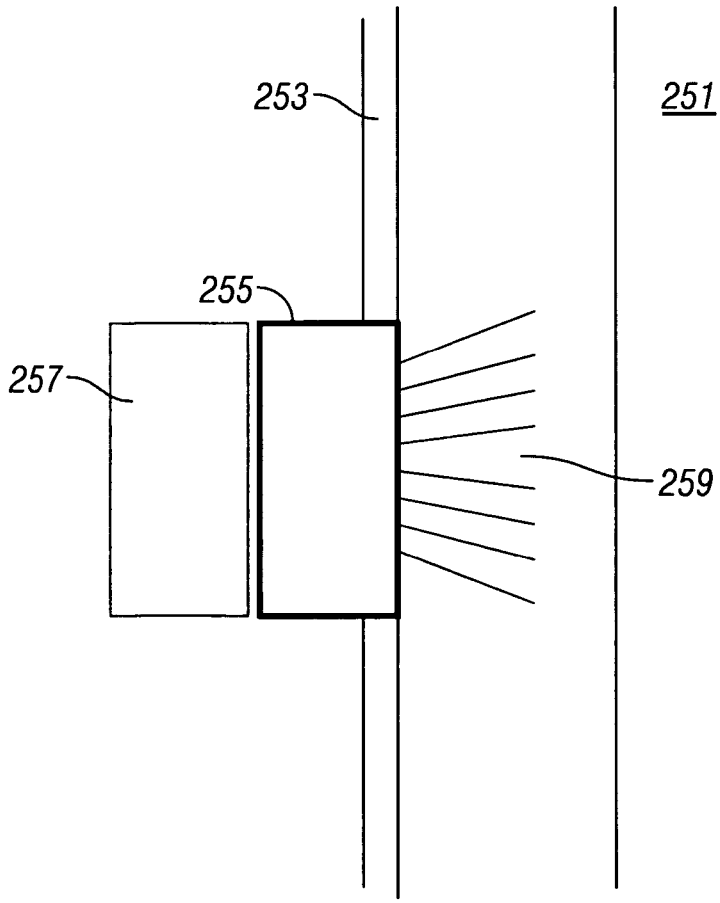
Figure 9:
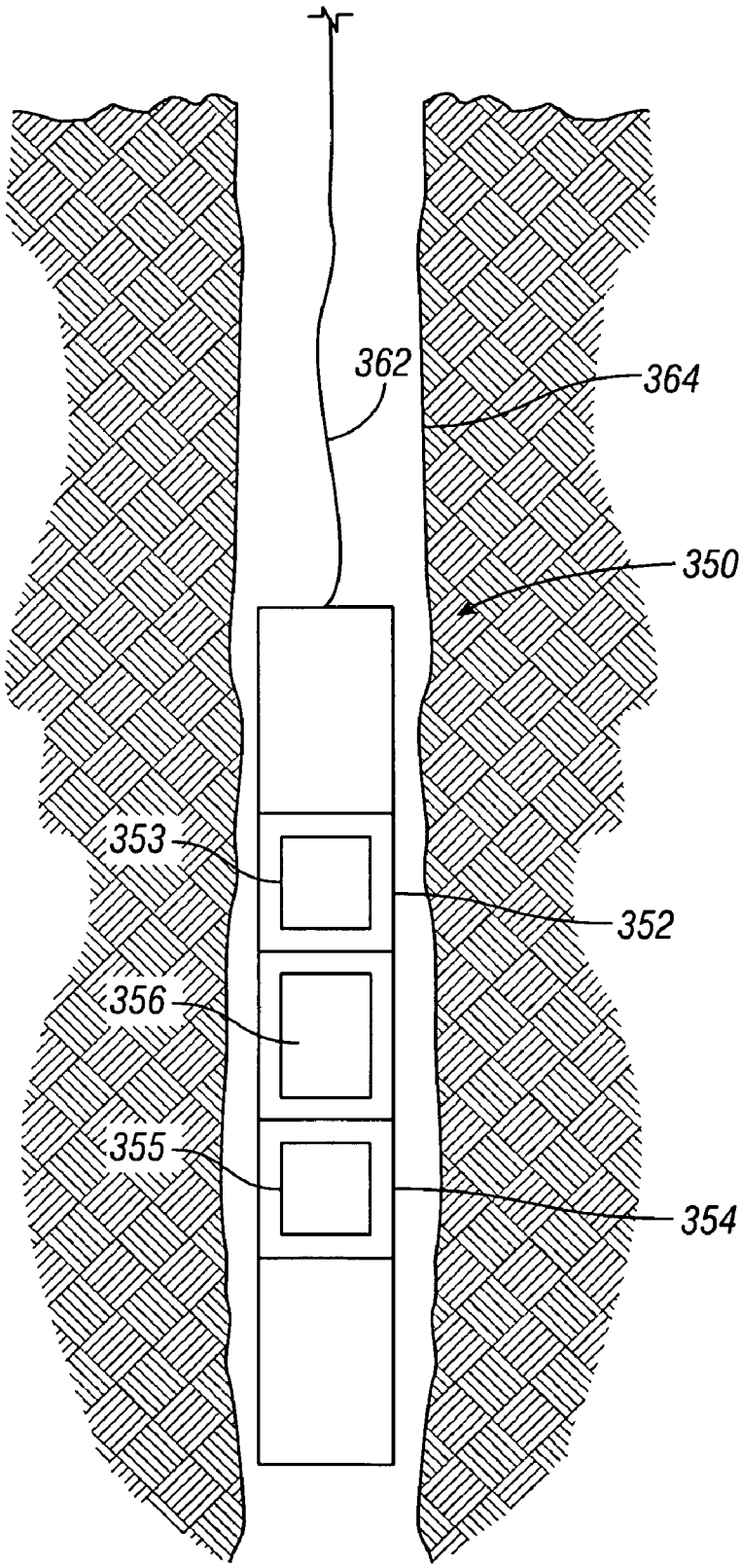
Figure 10A:
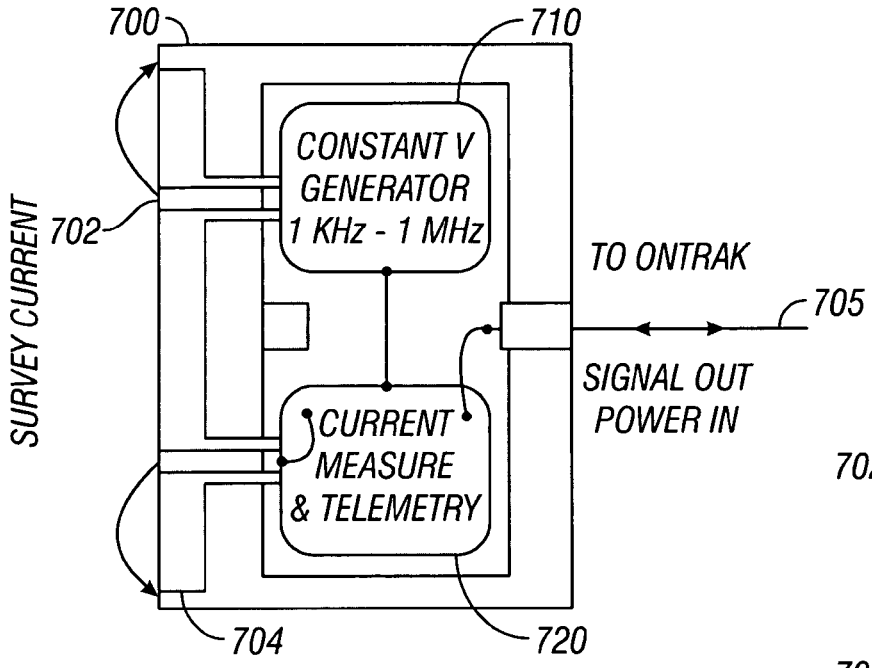
FIG. 10A (Prior Art)

FIGS, 6*c*-6*e* show the difference between classical theory (6*c*) and quantum tunneling (6*d*, 6*e*);

FIG. 7 is an illustration of one embodiment of the present invention for cooling electronic circuitry downhole;

FIG. 8 is an illustration of a second embodiment of the present invention for cooling electronic circuitry downhole;

FIG. 9 illustrates use of quantum thermocooling for a NMR apparatus having a trapped field magnet downhole; and FIG. 10 illustrates the use of quantum thermocooling for a resistivity at the bit device.

DETAILED DESCRIPTION OF THE INVENTION

Figure 1:
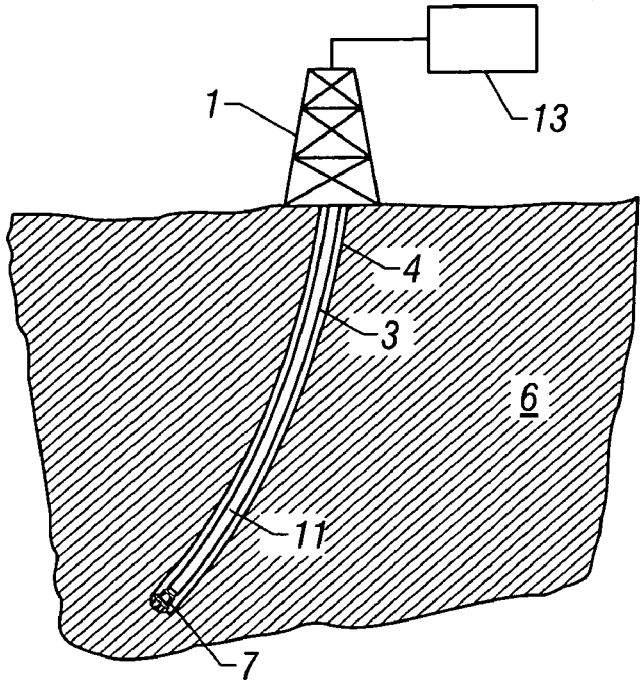
FIG. 1 (Prior Art)
FIG. 1 (prior art) is an illustration of a preferred embodiment of the present invention shown in a monitoring while drilling environment.
Figure 2:
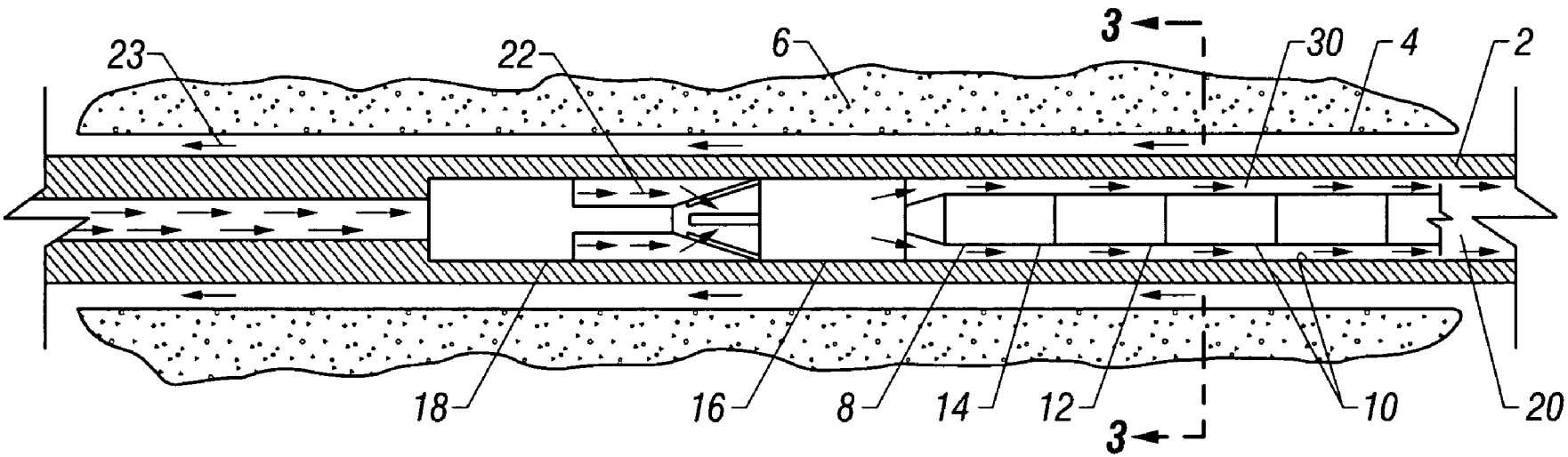
FIG. 2 (Prior Art)
FIG. 2 (prior art) is a longitudinal cross section through a portion of the down tool attached to the drillstring as shown in FIG. 1 incorporating the sorbent cooling apparatus of the present invention.

A drilling operation according to the current invention is shown in FIG. 1. A drill rig 1 drives a drillstring 3 which typically is comprised of a number of interconnecting sections. A bottomhole assembly (BHA) 11 is formed at the distal end of the drillstring 3. The BHA 11 includes a drillbit 7 that advances to form a borehole 4 in the surrounding formation 6. A portion of the BHA 11, incorporating an electronic system 8 and cooling systems according to the current invention, is shown in FIG. 2. The electrical system 8 may, for example, provide information to a data acquisition and analysis system 13 located at the surface. The electrical system 8 includes one or more electronic components. Such electronic components include those that incorporate transistors, integrated circuits, resistors, capacitors, and inductors, as well as electronic components such as sensing elements, including accelerometers, magnetometers, photomultiplier tubes, and strain gages.

The downhole portion 11 of the drillstring 3 includes a drill pipe, or collar, 2 that extends through the borehole 4. As is conventional, a centrally disposed passage 20 is formed within the drill pipe 2 and allows drilling mud 22 to be pumped from the surface down to the drill bit. After exiting the drill bit, the drilling mud 23 flows up through the annular passage formed between the outer surface of the drill pipe 2 and the internal diameter of the bore 4 for return to the surface. Thus, the drilling mud flows over both the inside and outside surfaces of the drill pipe. Depending on the drilling operation, the pressure of the drilling mud 22 flowing through the drill pipe internal passage 20 will typically be between 1,000 and 20,000 pounds per square inch, and, during drilling, its flow rate and velocity will typically be in the 100 to 1500 GPM range and 5 to 150 feet per second range, respectively.

As also shown in FIG. 2, the electrical system 8 is disposed within the drill pipe central passage 20. The electrical system 8 includes a number of sensor modules 10, a control module 12, a power regulator module 14, an acoustic pulsar module 18, and a turbine alternator 16 that are supported within the passage 20, for example, by struts extending between the modules and the drill pipe 2. According to the current invention, power for the electrical system 8, including the electronic components and sensors, discussed below, is supplied by a battery, a wireline or any other typical power supply method such as the turbine alternator 16, shown in FIG. 2, which is driven by the drilling mud 22. The turbine alternator 16 may be of the axial, radial or mixed-flow type. Alternatively, the alternator 16 could be driven by a positive displacement motor driven by the drilling mud 22, such as a Moineau-type motor. In other embodiments, power could be supplied by any power supply apparatus including an energy storage device located downhole, such as a battery.

Figure 3:
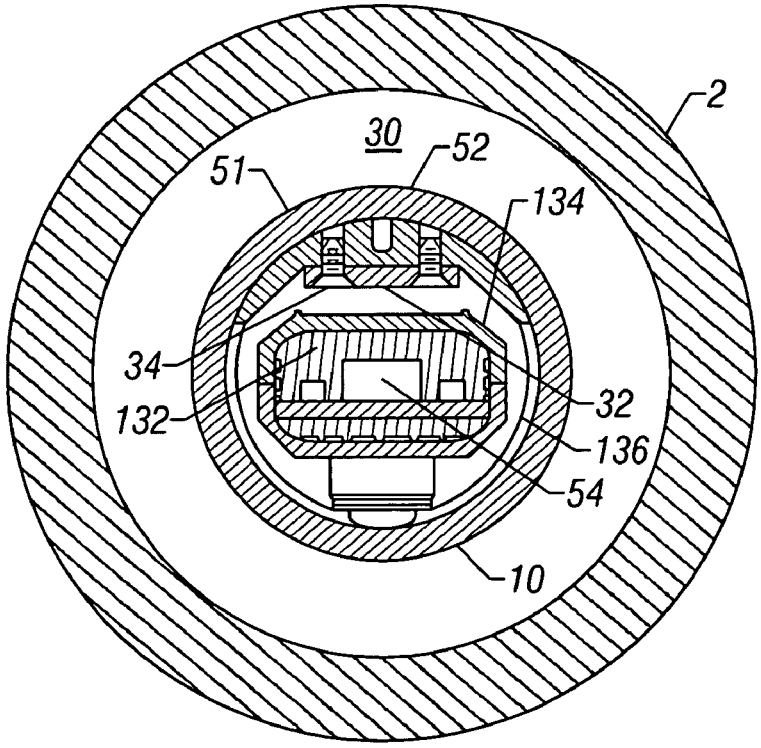
FIG. 3 (Prior Art)
FIG. 3 (prior art) is a transverse cross section through one of the sensor modules shown in FIG. 2 taken along line III-III.

As shown in FIG. 3, each sensor module 10 is comprised of a cylindrical housing 52, which in one embodiment is formed from stainless steel or a beryllium copper alloy. An annular passage 30 is formed between the outer surface 51 of the housing 52 and the inner surface of the drill pipe 2. The drilling mud 22 flows through the annular passage 30 on its way to the drill bit 7, as previously discussed. The housing 52 contains an electronic component 54 for the sensor module. The electronic component 54 may, but according to the invention does not necessarily, include one or more printed circuit boards associated with the sensing device, as previously discussed. Alternatively, the assembly shown in FIG. 3 could comprise the control module 12, power regulator module 14, or pulsar module 18, in which case the electronic component 54 may be different than those used in the sensor modules 10, although it may, but again does not necessarily, include one or more printed circuit boards. According to the current invention, one or more of the electronic components or sensors in the electrical system 8 are cooled by the cooling device 132 (discussed further below) adjacent to or surrounding electronics 54.

Figure 4:
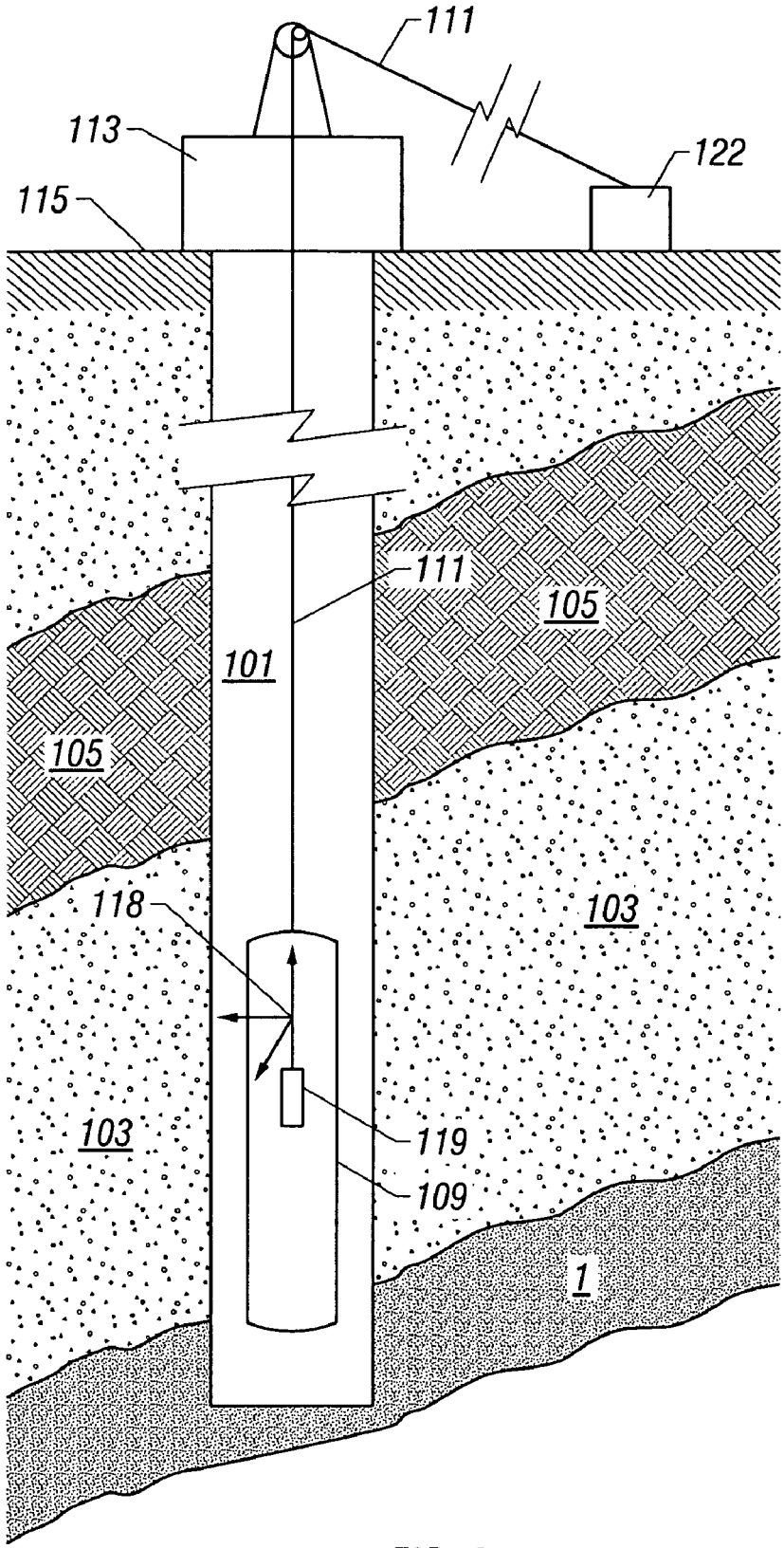
FIG. 4 (Prior Art)
FIG. 4 (prior art) is an illustration of an embodiment of the present invention shown deployed in a wireline environment.
Figure 5B:
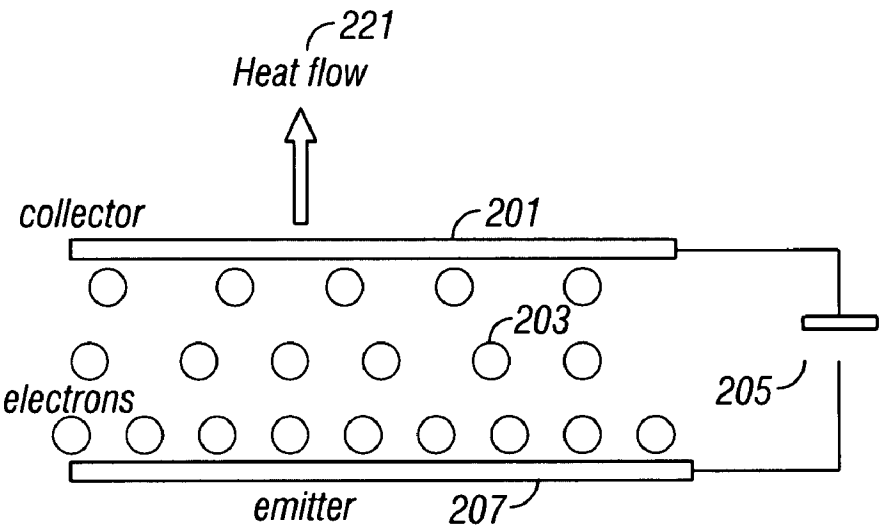
FIG. 5B (Prior Art)
FIG. 5*b* (prior art) is a schematic representation of a thermionic cooler.
Figure 5A:
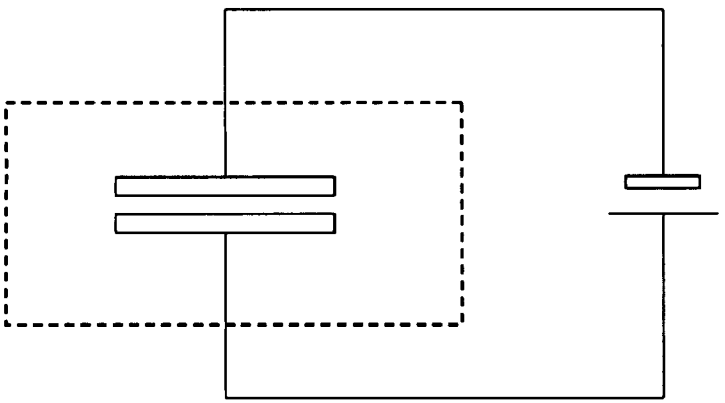
FIG. 5A (Prior Art)
FIG. 5*a* (prior art) is a circuit representation of a thermionic cooler.

Turning now to FIG. 4 a wireline deployment of the present invention is depicted. FIG. 4 schematically shows a borehole 101 extending into an earth formation, into a logging tool including sensors and electronics as used according to the present invention has been lowered. The well bore in FIG. 4 extends into an earth formation which includes a hydrocarbon-bearing sand layer 103 located between an upper shale layer 105 and a higher conductivity than the hydrocarbon bearing sand layer 103. An electronic logging tool 109 having sensors and electronics and a cooling device used in the practice of the invention has been lowered into the well bore 101 via a wireline 111 extending through a blowout preventer 113 (shown schematically) located at the earth surface 115. The surface equipment 122 includes an electric power supply to provide electric power to the set of coils 118 and a signal processor to receive and process electric signals from the sensors and electronics 119. Alternatively, a power supply and signal processor are located in the logging tool. In the case of the wireline deployment, the wireline may be utilized for provision of power and data transmission. Typically, the logging string includes a plurality of sensors for formation evaluation. Depending upon the types of sensors, one or more cooling devices may be provided. A downhole processor that is part of a logging string that operates at high temperatures would be have an associated cooling device. For the purposes of the present invention, the BHA and the logging string may be referred to as a downhole assembly.

As noted above, various types of sensors may be used for evaluation of the earth formation in either a wireline deployment or as part of a MWD implementation. The present invention is particularly important for use with certain types of sensors that have large power requirements (and thus may produce a considerable amount of heat), or require particularly low temperature for operation. These types of sensors will be described later.

Figure 6A:
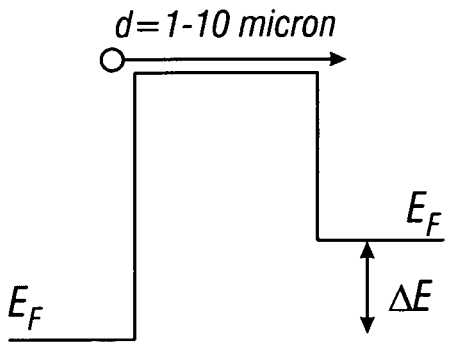
FIG. 6A (Prior Art)
FIG. 6*a* (prior art) depicts the potential barrier associated with thermionic emission.
Figure 6B:
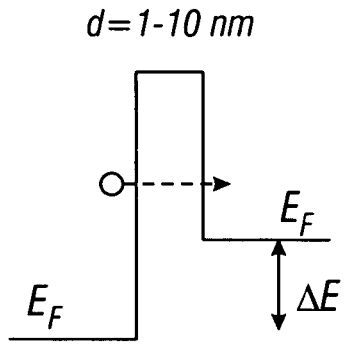
FIG. 6B (Prior Art)
FIG. 6*b* (prior art) depicts the potential barrier associated with quantum thermotunneling.

The present invention relies on improved thermoelectric devices in which the phenomenon of quantum tunneling is used advantageously. If the two electrodes are close enough to each other, electrons do not need to jump over a barrier. This is illustrated schematically in FIG. 6*b* where an electron is shown tunneling through a potential barrier. Under the laws of quantum mechanics, they can 'tunnel' from one side to another. The differences between classical (6*c*) and quantum mechanical behavior (6*d*, 6*e*) are illustrated in FIGS. 6*c*-6*e*.

Figure 6C:
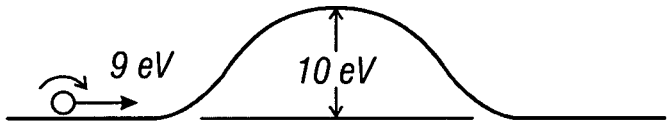
Figure 6D:
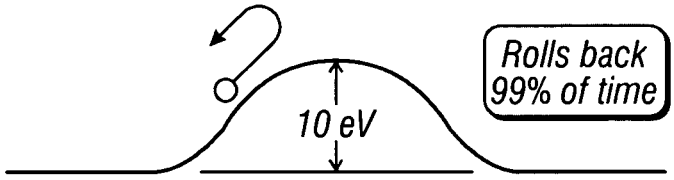
Figure 6E:
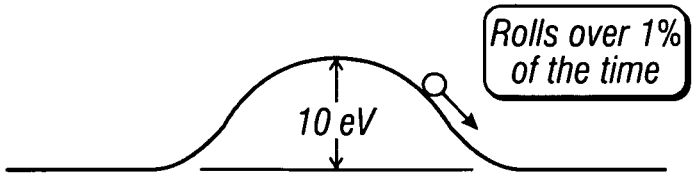

Depicted in FIG. 6*c* for illustrative purposes is an electron with an energy of say 9 eV approaching a barrier of height 10 eV. Under classical theory, the electron cannot go over the barrier as the energy of the electron is less than the energy needed to go over the barrier. Under the laws of quantum mechanics, however, the electron is characterized by a distribution of waves having certain statistical properties. It is entirely possible that 99% of the time, the waves characterizing the electron are reflected back as the electron impinges on the barrier, but may actually tunnel through the barrier 1% of the time. The numbers 99% and 1% are for illustrative purposes only, and the actual values in a particular situation would depend, among other things, upon the width of the barrier, and the height of the barrier.

In order for the quantum tunneling to take place and cooling to occur, the distance between the emitter and the collector in FIG. 6*c* should be on the order of 1-10 nm. Devices with spacings of this size are commercially available from Borealis Technical Limited under the mark Cool Chips™. Such devices have been described in U.S. Pat. No. 6,531,703 to Tavkhelidze. Devices with spacings of the order of 1-10 nm have several advantages. First, they can be made of standard, low work function material. Cooling densities can in theory be as high as 5000 watts/square centimeter. They can be operated at lower temperatures than prior devices. Higher efficiencies (up to about 55% of the Camot limit) are possible. The device may be referred to hereafter as a quantum thermocooler.

Turning now to FIG. 7, the use of a quantum thermocooler for downhole applications is illustrated. Shown therein is electronic circuitry 207 that may include a circuit board and/or a processor. The circuit board typically includes components that are to be kept below a specified temperature. This is also true of a processor. The processor, in particular, may be a significant heat source. The processor and circuit board are also examples of electronic components. Also shown in FIG. 7 are power leads 211 that connect the circuitry to a power source at a suitable location. For wireline applications, the power source may be at the surface and power supplied through the wireline. For MWD applications, the power source would be part of the BHA and could be a mud turbine.

The electronic components may be enclosed within an insulating flask 205. The flask may be a Dewar flask to minimize heat conduction to the electronic components. The quantum thermocooler 201 described above is in contact or proximity with to the electronic components and serves to pump out heat generated within the components, keeping the components cool. Insulation 203 may be provided to reduce heat conduction to the components. Optionally, a phase change material such as that described in DiFoggio may also be provided (not shown) within the Dewar flask.

Turning now to FIG. 8, another arrangement for cooling electronic components is disclosed. The circuitry 251 is in proximity with or in contact with the quantum thermocooler 255. Also shown is the tool housing 253, inside a borehole in the earth formation 251. Thermal fins 259 are provided to dissipate the heat that is transferred out of the electronic components by the quantum thermocooler. This arrangement may be used in wireline applications. For MWD applications, it would not be possible to have cooling fins on the outside of the drill collar. Accordingly, cooling fins may be provided for dissipating heat into fluid inside an internal bore 20 such as that shown in FIG. 2.

Certain types of sensors benefit greatly from having low temperatures. An example of such a sensor is a nuclear magnetic resonance sensor using a trapped field magnet. As discussed in U.S. Pat. No. 6,411,087 to Fan et al, the term TFM refers to a superconducting material below its critical temperature $T_c$ having a circulating current therein, the current being able to flow indefinitely within the superconducting material, thereby sustaining a magnetic field. The TFMs are made of material having a high $T_c$, so that the magnetic field can be sustained for the duration of the well logging by maintaining the TFMs at low temperature. The magnets are configured to provide a region of examination within the formation and at a distance form the borehole with the desired field strength. By using the TFMs, the field strength within this region is much higher than is attainable with conventional permanent magnets, giving a large signal to noise (SNR) ratio for the NMR signals. The magnetic field within the TFMs is kept at a low enough value that instability problems associated with these materials do not arise. This makes it possible to use the TFMs in an MWD environment. It should be noted that type 2 superconductors presently exist with a $T_c$ of 138° K, with a theoretical upper limit of 200° K. Such temperatures should be attainable with the quantum thermocoolers discussed above.

FIG. 9 shows an embodiment of the present invention suitable for use on a wireline. Shown is a logging tool 350 conveyed on a wireline 362 within a borehole 360. The logging tool includes two quantum thermocoolers 350, and 354 and the TFMs 353 and 355 contained therein. The RF coil section 336 is located between the two quantum thermocoolers. For simplifying the illustration, other sensors on the logging tool 350, the electronics for activating the RF transmitter and signal processing equipment are not shown. Other configurations of permanent magnets have been used in NMR applications. For example, U.S. Pat. No. 6,348,792 Beard et al, having the same assignee as the present invention and the contents of which are fully incorporated herein by reference, discloses a side looking gradient NMR tool. TFMs may be used with this and any other suitable magnet configuration. Due to the large static magnetic fields produced by the TFMs, resonance regions may be extended further into the formation without adversely affecting the signal to noise ratio (SNR).

One benefit of the configuration shown in FIG. 9 is that due to the cooling provided, dissipation of heat generated by pulsing of the antenna may also be handled, making it possible to pulse the antenna at higher power levels, thus further improving the signal to noise ratio.

Figure 10B:
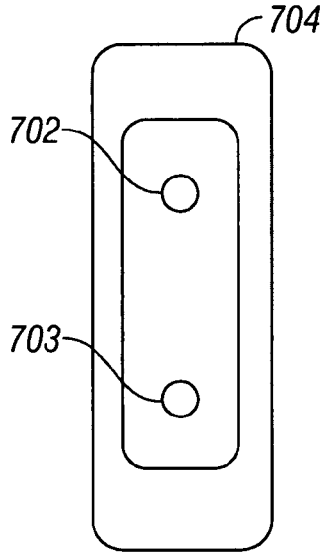
FIG. 10B (Prior Art)

Other types of sensors that could benefit from the quantum thermocoolers are those mounted at or near the drillbit, where due to the grinding action of the drillbit, there is considerable heat generation. U.S. Pat. No. 6,850,068 to Chemali et al. discloses a resistivity at bit device, shown in FIG. 10*a* with two electrodes, 702 and 703, in a dual electrode-micronormal system. The electrodes and electronics are disposed within the cavity of the blades. Insulation 704 isolates electrodes 702 and 703 electrically from the blade. FIG. 10*b* shows a view of the face of the electrode, wherein insulation 704 isolates electrodes 702 and 703 from the blade. The blade further comprises a current/voltage measurement and telemetry device 720. A survey current is established at electrode 702 and a survey voltage is measured at electrode 703. Current and voltage are measured via the device 720 which sends out the signal along line 705. Resistivity is obtained by taking a ratio of voltage to current with a suitable geometric calibration factor.

Once measurements have been made using the sensors, processing of the acquired data is done using a processor. The processor may be located downhole and may thus be cooled by the quantum thermocooler. When resistivity measurements are made, the processor may determine parameters of the earth formation such as horizontal and vertical resistivities, positions of interfaces such as bed boundaries and fluid contacts, etc. When NMR measurements are made, then parameters of interest that are commonly determined include bound volume irreducible, clay bound water, porosity, distribution of longitudinal relaxation time, distribution of transverse relaxation time, diffusivity, etc. Other types of sensors that may be used include gamma ray sensors, neutron sensors, fluid pressure sampling devices.

It should be pointed out that there are certain types of sensors such as laser devices that are rendered inoperative at temperatures below temperatures at which other electronic components such as processors are still functional. For this reason, it is envisaged that the cooling apparatus and methods discussed above are also applicable for these types of sensors (which are electronic components based on the dictionary definition above).

Implicit in the control and processing of the data is the use of a computer program implemented on a suitable machine readable medium that enables the processor to perform the control and processing. The machine readable medium may include ROMs, EPROMs, EAROMs, Flash Memories and Optical disks.

While the foregoing disclosure is directed to the specific embodiments of the invention, various modifications will be apparent to those skilled in the art. It is intended that all such variations within the scope and spirit of the appended claims be embraced by the foregoing disclosure.

What is claimed is:

1. An apparatus for cooling electronic components in a borehole, the apparatus comprising:

(a) a quantum thermocooler configured to use quantum thermotunneling to maintain downhole electronic components below a predefined temperature;

wherein a temperature of the borehole is higher than the predefined temperature.

2. The apparatus of claim 1 wherein the predefined temperature is less than about 200° C.

3. The apparatus of claim 1 wherein the quantum thermocooler comprises an emitter and a collector spaced apart by a distance less than about 20 nm.

4. The apparatus of claim 1 further comprising a Dewar flask which substantially encloses the electronic components.

5. The apparatus of claim 4 further comprising a phase change material within the Dewar flask, the phase change material facilitating maintaining the electronic components below the predefined temperature.

6. The apparatus of claim 1 further comprising thermal fins that enable the quantum thermocooler to convey heat from the electronic components to a fluid in the borehole.

7. The apparatus of claim 1 further comprising a downhole assembly including the electronic components wherein the electronic components are substantially inoperable above the predefined temperature.

8. The apparatus of claim 7 wherein the downhole assembly further comprises a bottomhole assembly (BHA) including a drillbit.

9. The apparatus of claim 8 further comprising at least one FE sensor on the drill bit.

10. The apparatus of claim 9 wherein the sensor on the drillbit comprises a resistivity sensor.

11. The apparatus of claim 7 wherein the downhole assembly further comprises a string of logging instruments.

12. The apparatus of claim 7 wherein the downhole assembly includes at least one formation evaluation (FE) sensor selected from the group consisting of (i) a gamma ray sensor, (ii) a resistivity sensor, (iii) a nuclear magnetic resonance sensor.

13. The apparatus of claim 12 wherein the at least one FE sensor comprises a nuclear magnetic resonance sensor including a trapped field magnet.

14. The apparatus of claim 7 wherein the downhole assembly includes a processor configured to determine from an output of at least one formation evaluation (FE) sensor a parameter of interest of the earth formation.

15. The apparatus of claim 14 wherein the parameter of interest is selected from the group consisting of (i) a horizontal resistivity of the formation, (ii) a vertical resistivity of the formation, (iii) a positions of an interface in the formation, (iv) a clay bound water of the formation, (v) bound volume irreducible, and (vi) porosity.

16. A method of evaluating an earth formation, the method comprising:

(a) conveying a downhole assembly including electronic components into a borehole (b) using quantum thermotunneling in a quantum thermocooler for cooling the electronic components to a temperature below a temperature of the borehole; and (c) using the electronic components to evaluate the earth formation.

17. The method of claim 16 wherein the downhole assembly further comprises a bottomhole assembly (BHA) including a drill bit, the method further comprising conveying the BHA on a drilling tubular.

18. The method of claim 17 wherein the at least one FE sensor further comprises a resistivity sensor on the drill bit.

19. The method of claim 16 wherein the downhole assembly includes at least one formation evaluation (FE) sensor configured to make a measurement of a parameter of interest of the earth formation.

20. The method of claim 19 wherein the downhole assembly further comprises a string of logging instruments conveyed on a wireline.

21. The method of claim 19 wherein the at least one (FE) sensor is selected from the group consisting of (i) a gamma ray sensor, (ii) a resistivity sensor, (iii) a nuclear magnetic resonance tool.

22. The method of claim 21 further comprising using the quantum cooler for cooling a trapped field magnet of a nuclear magnetic resonance tool below a critical temperature.

23. The method of claim 19 further comprising determining from an output of the at least one FE sensor the parameter of interest of the earth formation.

24. The method of claim 23 wherein the parameter of interest is selected from the group consisting of (i) a horizontal of the formation, (ii) a vertical resistivity of the formation, (iii) a positions of an interface in the formation, (iv) a clay bound water of the formation, (v) bound volume ineducible, and (vi) porosity.

25. The method of claim 16 further comprising maintaining the electronic components at a temperature less than about 200° C.

26. The method of claim 16 further comprising positioning an emitter and a collector of the quantum thermocooler by a distance less than about 20 nm.

27. The method of claim 16 further comprising enclosing the electronic components in a Dewar flask.

28. The method of claim 27 further comprising using a phase change material within the Dewar flask for maintaining the electronic circuitry below the predefined temperature.

29. The method of claim 16 further comprising using thermal fins for enabling the quantum thermocooler to convey heat to a fluid in the borehole.

30. An apparatus conveyed in a borehole, the apparatus comprising:

(a) a formation evaluation sensor configured to make a measurement of a property of an earth formation; and (b) a quantum thermocooler configured to use quantum thermotunneling to cool the formation evaluation sensor.

* * * * *

UNITED STATES PATENT AND TRADEMARK OFFICE

CERTIFICATE OF CORRECTION

PATENT NO. : 7,571,770 B2
APPLICATION NO. : 11/087362
DATED : August 11, 2009
INVENTOR(S) : Rocco DiFoggio and Frederick E. Shipley It is certified that error appears in the above-identified patent and that said Letters Patent is hereby corrected as shown below:

Column 12 claim 24, line 15, delete "ineducible" and insert --irreducible--.

Signed and Sealed this

Twenty-second Day of September, 2009

David J. Kappos

David J. Kappos
*Director of the United States Patent and Trademark Office*